US010980300B2

(12) United States Patent
Ito et al.

(10) Patent No.: US 10,980,300 B2
(45) Date of Patent: Apr. 20, 2021

(54) STITCH STRUCTURE

(71) Applicant: GOLDWIN INC., Toyama (JP)

(72) Inventors: Ryota Ito, Toyama (JP); Keiko Takenami, Toyama (JP); Kazuhiro Kemma, Toyama (JP)

(73) Assignee: GOLDWIN INC., Toyama (JP)

( * ) Notice: Subject to any disclaimer, the term of this patent is extended or adjusted under 35 U.S.C. 154(b) by 203 days.

(21) Appl. No.: 15/326,212

(22) PCT Filed: Jul. 15, 2015

(86) PCT No.: PCT/JP2015/070316
§ 371 (c)(1),
(2) Date: Jan. 13, 2017

(87) PCT Pub. No.: WO2016/010091
PCT Pub. Date: Jan. 21, 2016

(65) Prior Publication Data

US 2017/0196286 A1 Jul. 13, 2017

(30) Foreign Application Priority Data

Jul. 15, 2014 (JP) ..... JP2014-145443

(51) Int. Cl.
*A41D 27/24* (2006.01)
*D05B 1/10* (2006.01)
*D05B 93/00* (2006.01)

(52) U.S. Cl.
CPC ..... *A41D 27/24* (2013.01); *D05B 1/10* (2013.01); *D05B 93/00* (2013.01)

(58) Field of Classification Search
CPC ..... A41D 27/24; A41D 27/245; D05B 1/10; D05B 93/00
See application file for complete search history.

(56) References Cited

U.S. PATENT DOCUMENTS 2,975,737 A 3/1961 Lukins
3,540,975 A * 11/1970 Guild ..... B29C 66/836 428/194

(Continued)

FOREIGN PATENT DOCUMENTS

DE 2042732 A1 3/1972
EP 0897030 A2 2/1999

(Continued)

OTHER PUBLICATIONS

Espacenet English Language Translation of FR2568108 Schrieber Michel Albert Leon, Jan. 31, 1986, translation provided by Applicant which was dated Mar. 26, 2018.*

(Continued)

*Primary Examiner* — Alissa L Hoey
*Assistant Examiner* — Patrick J. Lynch
(74) *Attorney, Agent, or Firm* — Osha Bergman Watanabe & Burton LLP

(57) ABSTRACT

A stitch structure has a first surface, a second surface, and includes: a first fabric having a first end section; a second fabric having a second end section; a first stitching that extends in a direction substantially parallel to the direction of extension of the first end section; a second stitching that extends in a direction substantially parallel to the direction of extension of the second end section; a third stitching; and a tape-shaped member. Additionally, a first thread and a second thread is arranged in the first stitching and the second stitching, respectively, to repeatedly return across and penetrate the first fabric and the second fabric, in the thickness direction thereof. A decorative thread is arranged in the third stitching to repeatedly span between at least the first thread and the second thread and the tape-shaped member is binding the first fabric and the second fabric.

7 Claims, 6 Drawing Sheets

(56) References Cited

U.S. PATENT DOCUMENTS

| | | | | | |
|---|---|---|---|---|---|
| 5,077,837 | A * | 1/1992 | Meistrell | A41D 13/065 2/16 |
| 5,603,123 | A * | 2/1997 | Chupa | A41D 13/129 2/275 |
| 6,124,010 | A * | 9/2000 | Shih | A41D 27/24 428/60 |
| 2007/0056491 | A1 | 3/2007 | Yasuzawa | |
| 2009/0233042 | A1 * | 9/2009 | Sadato | A41D 27/24 428/104 |
| 2010/0077634 | A1 * | 4/2010 | Bell | A41D 27/24 36/54 |
| 2010/0077949 | A1 | 4/2010 | Hayashida | |
| 2011/0030596 | A1 | 2/2011 | Boinais et al. | |
| 2014/0182498 | A1 | 7/2014 | Torigoe | |

FOREIGN PATENT DOCUMENTS

| | | | | |
|---|---|---|---|---|
| EP | 0971061 | A1 | 1/2000 | |
| EP | 2716804 | A1 | 4/2014 | |
| FR | 1031453 | * | 6/1953 | A41D 27/24 |
| FR | 2568108 | A1 | 1/1986 | |
| GB | 1109050 | A * | 4/1968 | A41D 27/245 |
| GB | 1124856 | A * | 8/1968 | D05B 93/00 |
| JP | S605188 | A | 1/1985 | |
| JP | H01-102179 | U | 7/1989 | |
| JP | H08-238389 | A | 9/1996 | |
| JP | 2003-095191 | A | 4/2003 | |
| JP | 2005-531695 | A | 10/2005 | |
| JP | 2007169812 | A | 7/2007 | |
| JP | 2012081184 | A | 4/2012 | |
| JP | 2013/034668 | A | 2/2013 | |
| WO | 03/057482 | A2 | 7/2003 | |

OTHER PUBLICATIONS

JPlatPat English Language Translation of JP H08-238389A, Nippon Union Special, Sep. 17, 1996, translation provided by Applicant with no translation date provided (date unknown).*

Merriam-Webster, "staddle", www.merriam-webster.com/dictionary/straddle (Nov. 13, 2018).*

Merriam-Webster, "while", www.merriam-webster.com/dictionary/while (Nov. 13, 2018).*

English language translation for FR 1031453 to Karlsruhe, obtained via espacenet.com (last visited Nov. 1, 2019) (Year: 1953).*

Extended European Search Report issued in corresponding European Application No. 15822039.2 dated Feb. 16, 2018 (9 pages).

International Search Report dated Oct. 6, 2015, issued by the Japan Patent Office in corresponding International Application No. PCT/JP2015/070316, with English translation (5 pages).

* cited by examiner

STITCH STRUCTURE

TECHNICAL FIELD

The present disclosure relates to a seam structure.

BACKGROUND ART

Flat seaming is a known method for sewing of fabrics, wherein the edges of two fabrics are stitched together. In a flat seaming sewing method, 4 needles are used, for example, to compose the seam of 6 threads (4 needle threads, 1 looper thread and 1 top cover thread), and the outlet seam is flat (see Patent Literature ("PTL") 1 and 2, for example as listed in the citation list below). The sewing machine using for flat seaming is a 4-needle, feed-off-the-arm, interlock stitch machine, and the seam formed by flat seaming is called a "flat seam".

In flat seaming, the stitching is performed with the fabric edges are in contact with each other, and therefore the sewn sections are soft and few irregularities result. Clothing that has been sewn by flat seaming therefore has no outlet seam on the back side of the fabric, such that the skin does not contact with an outlet seam and stress on the skin is thereby alleviated. In other words, a satisfactory fitting feel is provided for the wearer. In addition, flat seaming is more responsive to fabric elongation compared to common sewing methods, and the strength and durability of the sewn sections are highly superior.

Flat seaming is therefore widely employed not only for underwear; however, also for sportswear including swimwear, athletic competition uniforms and wet suits.

CITATION LIST

Patent Literature

PTL 1 Japanese Unexamined Patent Publication HEI No. 8-238389

PTL 2 Japanese Unexamined Patent Publication No. 2013-34668

SUMMARY OF INVENTION

However, although there are no outlet seams with 2-needle, flatbed, interlock stitch machines and 4-needle, feed-off-the-arm, interlock stitch machines, raised sections having decorative threads are nevertheless present on the skin side when worn, and the feel on the skin can potentially be uncomfortable due to the raised sections and decorative threads. Furthermore, removing the decorative threads on the skin side exposes the skin side to the fabric edges, and reduces the quality. Embodiments in the present disclosure provide a seam structure with minimal skin contact and excellent quality.

The present inventors have devised a seam structure comprising a first fabric having a first edge, a second fabric having a second edge, the second fabric being disposed adjacent to the first fabric such that a direction in which the second edge extends is essentially parallel to a direction in which the first edge extends, a first seam formed by a first thread and extending in a direction essentially parallel to the direction in which the first edge extends, a second seam formed by a second thread and extending in a direction essentially parallel to the direction in which the second edge extend, a third seam formed by a decorative thread, and a tape-like member having a base and a bonded section, the seam structure having a first surface and a second surface, wherein at the first seam, the first thread is disposed so as to run through at least the first fabric in a repetitive reciprocating manner in a thickness direction thereof, at the second seam, the second thread is disposed so as to run through at least the second fabric in a repetitive reciprocating manner in a thickness direction thereof, the third seam is disposed on the first surface, and at the third seam, the decorative thread is disposed so as to repetitively straddle across at least the first thread and the second thread, and the tape-like member is disposed on the second surface, the bonded section of the tape-like member bonding the first fabric and the second fabric.

The seam structure of the disclosure has minimal skin contact and excellent quality.

DESCRIPTION OF EMBODIMENTS

Embodiments of the disclosure will now be explained with reference to the accompanying drawings, with the understanding that the disclosure is not limited to the embodiments.

First Embodiment

Figure 1:
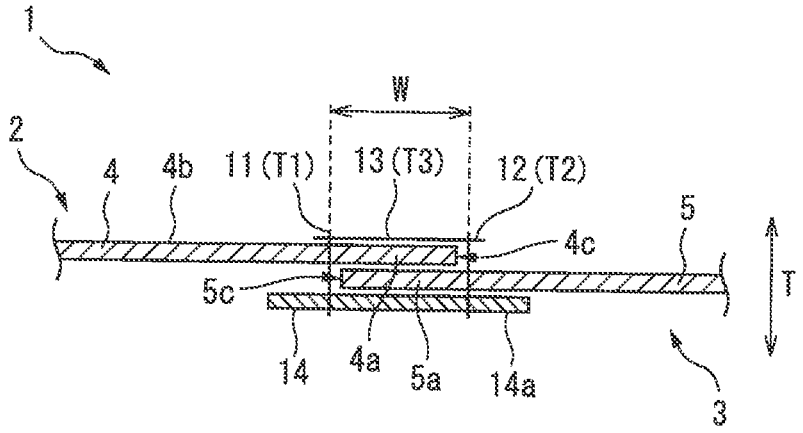
FIG. 1 is a schematic cross-sectional view of a seam structure 1 according to a first embodiment of the disclosure.
Figure 2:
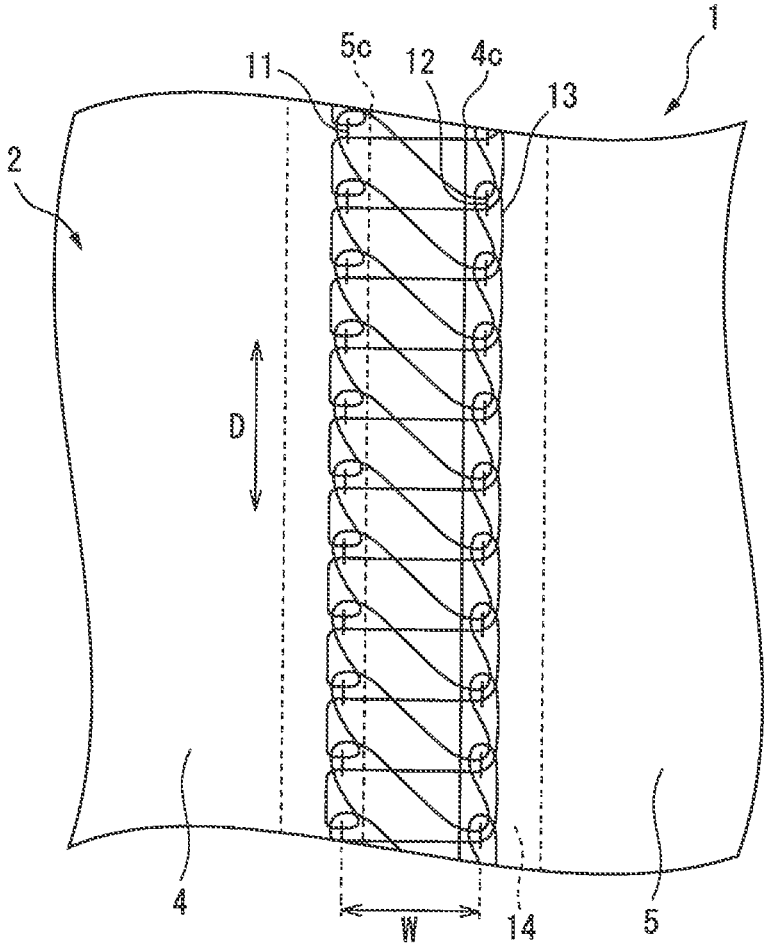
FIG. 2 is a schematic plan view of the first surface 2 of the seam structure 1 according to the first embodiment of the disclosure.
Figure 3:
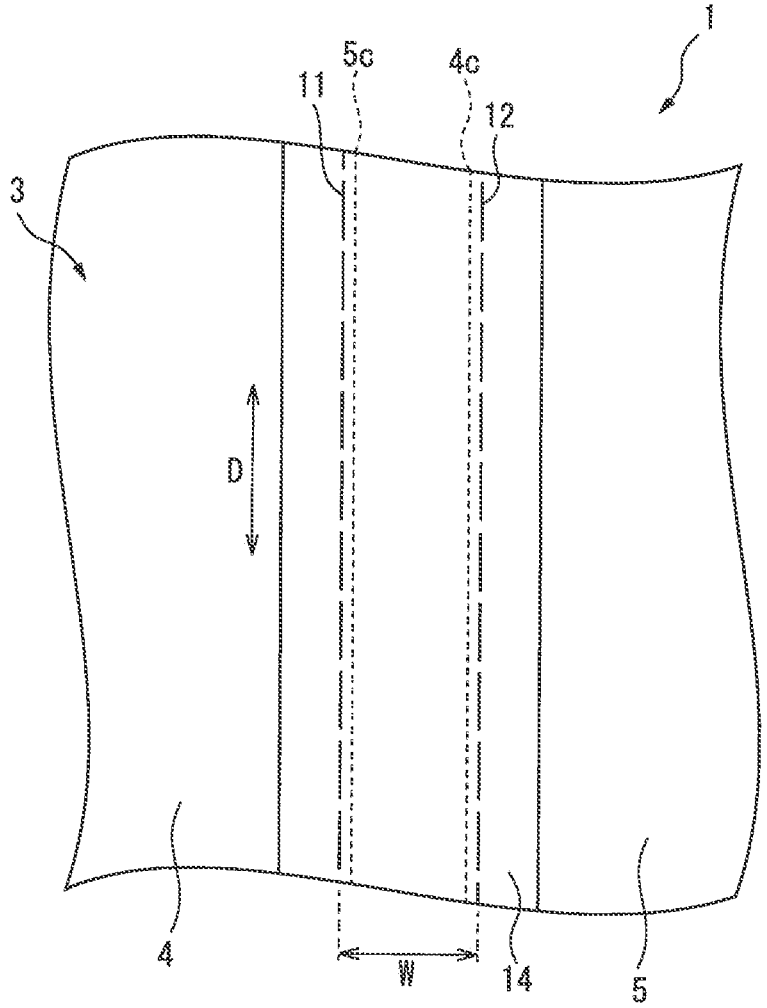
FIG. 3 is a schematic plan view of the second surface 3 of the seam structure 1 according to the first embodiment of the disclosure.

FIG. 1 to FIG. 3 are diagrams schematically showing a seam structure 1 according to the present embodiment, FIG. 1 being a cross-sectional view, FIG. 2 being a plan view of the first surface 2 of the seam structure 1, and FIG. 3 being a plan view of the second surface 3 of the seam structure 1.

The seam structure 1 of the disclosure comprises a first fabric 4 having a first edge 4*a*, a second fabric 5 having a second edge 5*a*, a first seam 11 formed by a first thread T1 and extending in a direction essentially parallel to the direction D in which the first edge 4*a* extends, a second seam 12 formed by a second thread T2 and extending in a direction essentially parallel to the direction D in which the second edge 5*a* extends, a third seam 13 formed by a decorative thread T3, and a tape-like member 14 having a base and a bonded section, the seam structure having a first surface 2 and a second surface 3. The first seam 11 and second seam 12 are disposed running in an essentially parallel direction (direction D) across a fixed width W.

For this embodiment, the first fabric 4 and second fabric 5 are disposed in an adjacent manner such that the direction in which the first edge 4*a* extends and the direction in which the second edge 5*a* extends are an essentially parallel direction (direction D). Also, the first fabric 4 and second fabric 5 are disposed with the first edge 4*a* and second edge 5*a* overlapping in the thickness direction T of the seam structure 1.

At the first seam 11, the first thread T1 is disposed in a manner running through the first fabric 4 and tape-like member 14 in a repetitive reciprocating manner in the thickness direction T of the first fabric 4 and tape-like member 14. At the first seam 11, the first thread T1 repetitively reciprocates between the surface 4*b* of the first fabric 4 on the first surface 2 of the seam structure 1, and the surface 14*a* of the tape-like member 14 on the second surface 3 of the seam structure 1.

At the second seam 12, the second thread T2 is disposed in a manner running through the second fabric 5 and tape-like member 14 in a repetitive reciprocating manner in the thickness direction T of the second fabric 5 and tape-like member 14. At the second seam 12, the second thread T2 repetitively reciprocates between the surface 4*b* of the first fabric 4 on the first surface 2 of the seam structure 1, and the surface 14*a* of the tape-like member 14 on the second surface 3 of the seam structure 1.

The third seam 13 is disposed on the first surface 2 of the seam structure 1, and at the third seam 13, the decorative thread T3 is disposed so as to repetitively straddle across the first thread T1 and the second thread T2. For this embodiment, the third seam 13 meanders between the first thread T1 and the second thread T2.

The tape-like member 14 is disposed on the second surface 3, with the bonded section of the tape-like member 14 bonding the first fabric 4 and the second fabric 5.

For this embodiment, the edge face 4*c* of the first edge 4*a* of the first fabric 4 and the edge face 5*c* of the second edge 5*a* of the second fabric 5 lie between the first seam 11 and the second seam 12.

For this embodiment, the second surface 3 of the seam structure 1 is used as the skin side, so that the wearer is less likely to experience a contacting feel on the skin. On the second surface 3, the joining section of the first fabric 4 and the second fabric 5 is covered by the tape-like member 14, and therefore the quality is excellent.

In the embodiment shown in FIG. 1 to FIG. 3, the edge face 4*c* of the first edge 4*a* of the first fabric 4 and the edge face 5*c* of the second edge 5*a* of the second fabric 5 lie between the first seam 11 and the second seam 12, however according to the present disclosure, at least the edge face of the first edge of the first fabric lies between the first seam and the second seam, whereby the edge face of the first edge is covered by the third seam (decorative thread) and cannot be directly seen from the exterior, resulting in an excellent aesthetic quality.

According to the present disclosure, the edge face of the second edge of the second fabric does not need to lie between the first seam and the second seam, from the viewpoint of quality.

In the embodiment shown in FIG. 1 to FIG. 3, the edge face 5*c* of the second edge 5*a* of the second fabric 5 lies between the first seam 11 and the second seam 12; however, in a seam structure according to another embodiment of the disclosure, the edge face of the second edge of the second fabric may lie on the outer side of the first seam (the side opposite from the second seam side). If the tape-like member bonds the first fabric and second fabric, i.e. if it covers the edge face of the second edge of the second fabric, then problems related to the feel on the skin due to the edge face of the second edge will be less likely to occur. In addition, if the edge face of the second edge of the second fabric lies on the outer side of the first seam, the first seam will be disposed so as to run through at least the first fabric and second fabric in a repetitive reciprocating manner in the thickness direction, and therefore the strength of the seam structure will be increased.

In the embodiment shown in FIG. 1 to FIG. 3, the first thread T1 in the first seam 11 is disposed so as to run through the first fabric 4 and tape-like member 14 in a repetitive reciprocating manner in their thickness direction T; however, according to the present disclosure, the strength of the seam structure will be increased if the first seam is disposed so as to run through the members including the tape-like member in a repetitive reciprocating manner in their thickness direction.

Likewise, the strength of the seam structure will be increased if the second seam is similarly disposed so as to run through the members including the tape-like member in a repetitive reciprocating manner in their thickness direction.

For the present disclosure, the first fabric and second fabric are not particularly restricted and may each be a fabric commonly used in the technical field, such as a woven fabric, knitted fabric or nonwoven fabric.

The threads, including the first thread, second thread and decorative thread (and the third thread and fourth thread mentioned below), may be ones commonly used in the technical field for flat seaming, for example, and they are preferably ones with easy elongation in order to avoid inhibiting elongation of the first fabric and second fabric.

There are no particular restrictions on the base of the tape-like member, and it may be a fabric, such as a woven fabric, knitted fabric or nonwoven fabric, and considering the possibility of direct contact with the skin of the wearer, it is preferably one that is soft and easily elongated, such as a knitted fabric. When the base of the tape-like member is a knitted fabric and the first seam and second seam are exposed on the surface of the tape-like member, the first thread and second thread forming the first seam and second seam, respectively, can settle into the base which is a knitted fabric, thereby improving the feel of the second surface on the skin.

If the base of the tape-like member is a woven fabric, the thickness of the tape-like member will be smaller than when it is a knitted fabric; however, the first seam and second seam will be less able to settle into the base, the wearer will be more likely to feel the first seam and second seam on the second surface, and the feel on the skin will tend to be impaired.

The bonded section of the tape-like member may be one that is commonly employed in the technical field, and for example, it may be one having an adhesive property at room temperature, or having an adhesive property upon heating.

Examples for the tape-like member include types having a base made of a polyester based knitted fabric and having a polyurethane-based hot-melt adhesive. The tape-like member is pressed at a high temperature, such as 150° C., for bonding of the first fabric and second fabric.

The tape-like member preferably has a certain degree of thickness from the viewpoint described above; however, if it is too thick the tape-like member itself will form a raised section, reducing the feel on the skin and the visual quality. Therefore, the thickness of the tape-like member is not particularly restricted; however, is preferably about 0.1 mm to 0.5 mm, for example.

Figure 4:
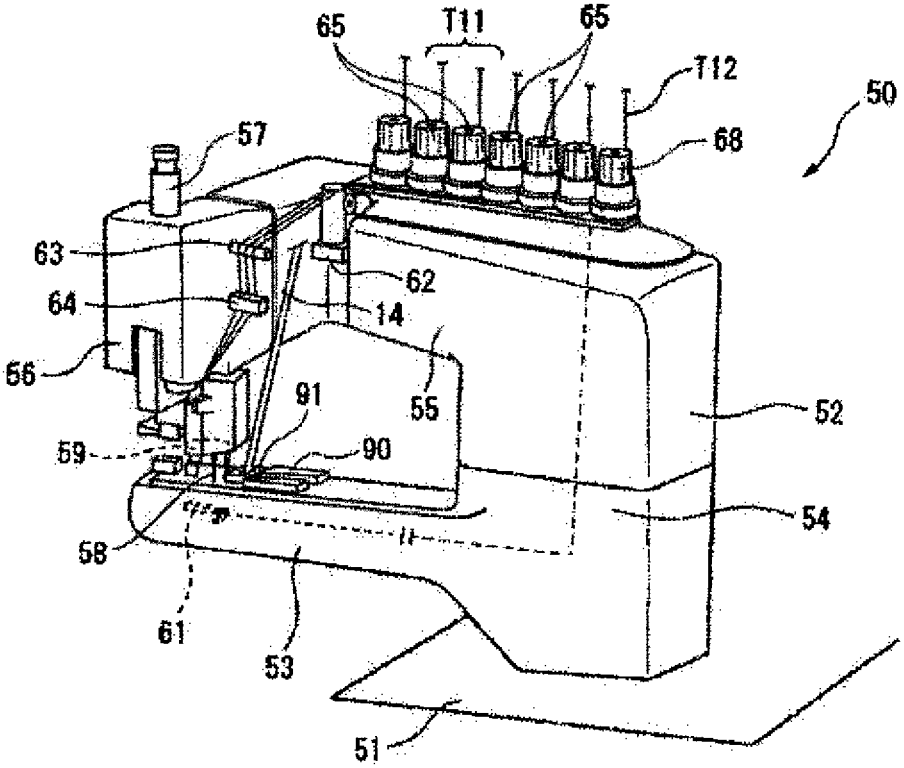
FIG. 4 is a perspective view showing an example of a sewing machine to be used for forming a seam structure of the disclosure.

FIG. 4 is a perspective view showing an example of a sewing machine 50 to be used to form the seam structure 1 according to this embodiment. The sewing machine 50 basically has the same construction as a conventional 4-needle flat seamer.

According to this embodiment, with the 2 needles and needle threads on the outer side among 4 needles, and the upper decorative thread, removed from a conventional 4-needle, feed-off-the-arm, interlock stitch machine, the first seam and second seam are formed by the two inside needle threads, and the decorative thread on the first surface is formed by a looper thread.

The sewing machine 50 includes a sewing machine main body 52 anchored to a base 51, and a bed 53 provided extending from the sewing machine main body 52.

The sewing machine main body 52 has an essentially L-shape, with a rising portion 54 rising upward from the base 51, a horizontal portion 55 curving at an approximate right angle from the top end of the rising portion 54 and extending in the horizontal direction, and a needle bar guide 56 provided at the tip section of the horizontal portion 55. At the needle bar guide 56, a needle bar 57 is in a reciprocally movable state in the vertical direction, and is housed in a state with its top end protruding upward from the needle bar guide 56. The needle bar 57 has mechanical power transferred from a motor (not shown) provided in the base 51, whereby it is reciprocally driven in the vertical direction. At the bottom of the needle bar guide 56 there are provided two needles 58 on the lower end of the needle bar 57. The two needles 58 move up and down as the needle bar 57 is driven to move up and down.

The bed 53 is disposed extending essentially in the horizontal direction from the rising portion 54 of the sewing machine main body 52, with its tip section facing two needles 58 provided on the needle bar guide 56. Inside the bed 53 there is provided a lower looper 61, near the tip section, i.e. at the position facing the lower ends of the needles 58. The lower looper 61 moves in an elliptical orbit, in synchronization with movement of the needles 58 in the vertical direction. The needle thread T11 is supplied to the two needles 58 from a thread winding reel (not shown), through a first thread guide piece 62, a second thread guide piece 63 and a third thread guide piece 64. Each needle thread T11 has its tensile force adjusted separately by tension adjusting means 65 lying between the first thread guide piece 62 and thread winding reel (not shown). At the lower looper 61, decorative thread T12 is provided through the sewing machine main body 52 from a thread winding reel (not shown), via tension adjusting means 68. The tensile force of the decorative thread T12 supplied to the lower looper 61 is thus easily adjusted.

In particular, the sewing machine 50 is provided with a fabric cutter 90 that cuts a first edge of a first fabric and a second edge of a second fabric, and tape-like member supply means (not shown) that supplies a tape-like member 14 toward the section between the fabric cutter 90 and the needles 58. The tape-like member 14 is layered over the first fabric and second fabric through a guide hole 91.

Figure 5:
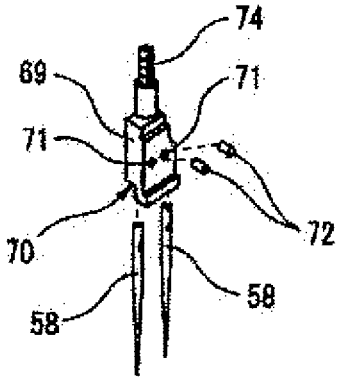
FIG. 5 is an exploded perspective view showing a needle cage and needles, in the sewing machine shown in FIG. 4.

FIG. 5 is an exploded perspective view showing a needle cage 69 and two needles 58. The needle cage 69 has an essentially rectangular cross-sectional shape, and it has insertion holes 70 through which the two needles 58 are inserted.

The two needles 58 are inserted into the insertion holes 70 and fixing bolts 72 are screwed into the screw holes 71, so that they are fixed in the needle cage 69. The insertion holes 70 are rectangular, and the two needles 58 are fixed alongside each other in the widthwise direction of the needle cage 69.

The two needles 58 are fixed in the needle cage 69, and a fitting section 74, having an outer screw formed on the side opposite the side on which the two needles 58 are fitted, is screw-fitted into the needle bar 57 to fit the two needles 58 onto the needle bar 57.

Figure 6:
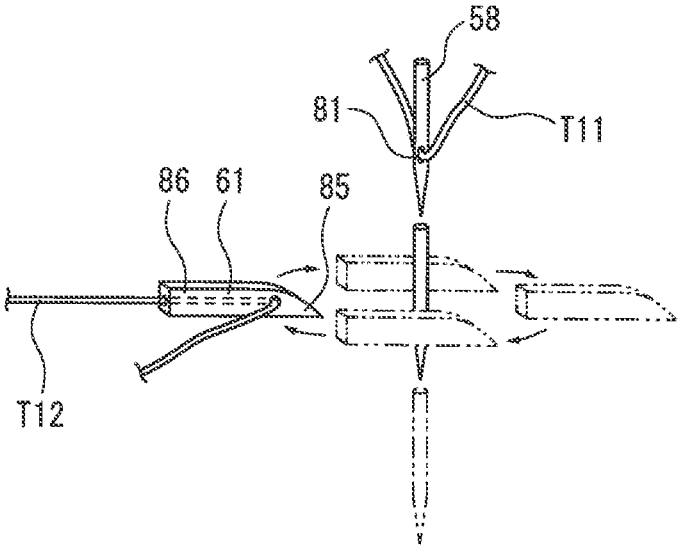
FIG. 6 is a perspective view showing the pet of movement of a needle and lower looper.

FIG. 6 is a perspective view showing the path of movement of a needle 58 and lower looper 61 in a sewing machine 50. The needle 58 has an insertion hole 81 formed near the tip section, the needle thread T1 being inserted into the insertion hole 81. The needle 58 reciprocally moves up and down, forming a first seam (and second seam).

The lower looper 61 has a longitudinal form, with a pointed tip section 85. Decorative thread T12 is inserted in the lower looper 61 in the interior from the rear end 86 side to near the tip section 85. A third seam is formed when the decorative thread T12 is operated by the lower looper 61. The lower looper 61 moves in an ellipsoid fashion enveloping the path through which the needle 58 passes, in the plane essentially perpendicular to the vertical direction of the needle 58. The movement of the lower looper 61 in the elliptical orbit takes place in synchronization with the up/down movement of the needle 58.

By the mutually synchronous movement of the needle 58 and lower looper 61, a mutually engaged relationship is created between the needle thread T11 and decorative thread T12, as mentioned above.

Figure 7:
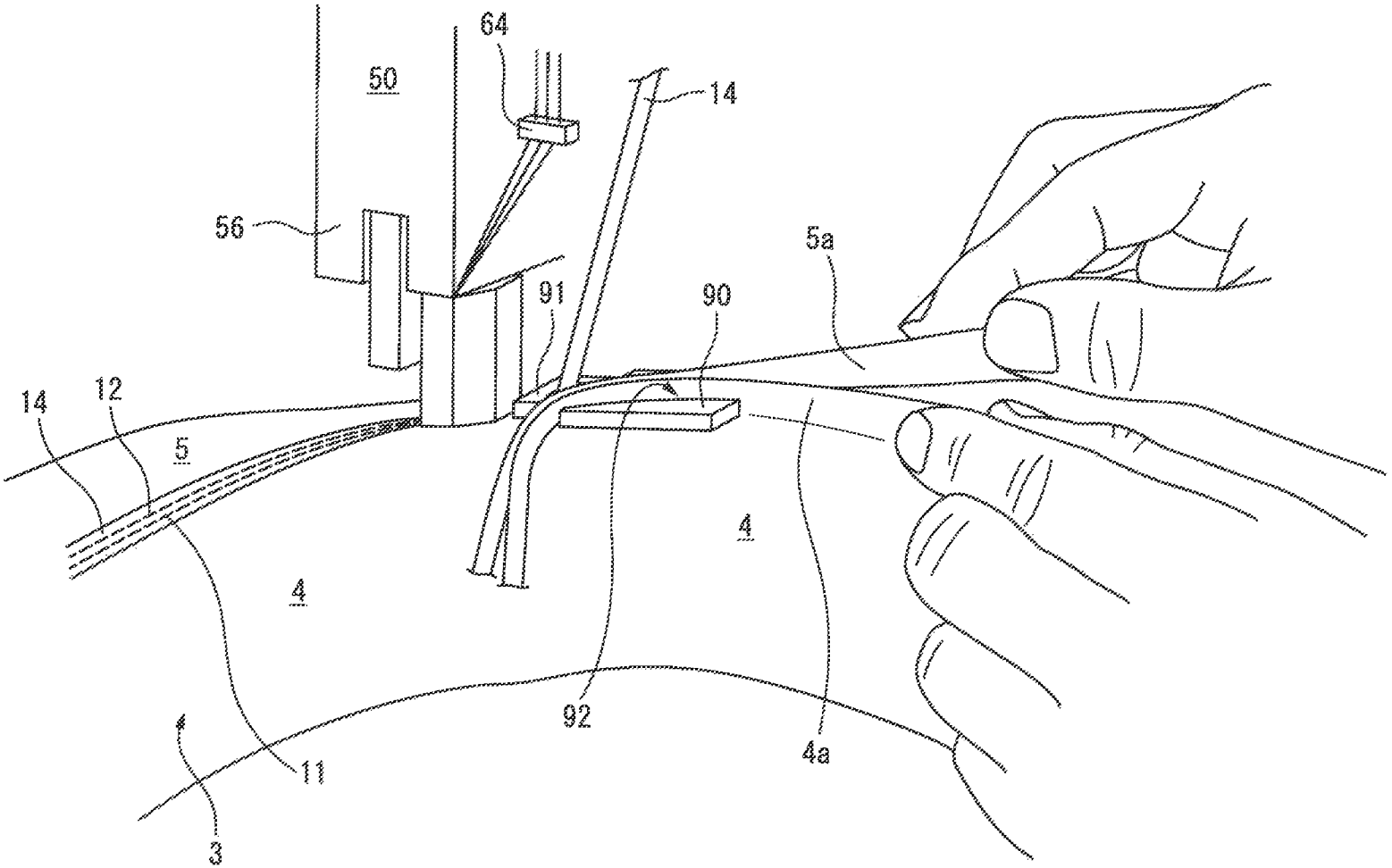
FIG. 7 is a diagram schematically showing a state of sewing together two fabrics using the sewing machine shown in FIG. 4.

FIG. 7 is a diagram schematically showing a state of sewing together two fabrics using the sewing machine 50.

The first fabric 4 and second fabric 5 are introduced into the sewing machine 50 along a wrap former 92 with the sides that are to form the second surface 3 facing upward, and with the first edge 4*a* and second edge 5*a* joined together.

The fabric cutter 90 cuts the outlet seam portion of the first fabric 4 (a portion of the first edge 4*a*), and the outlet seam portion of the second fabric 5 (a portion of the second edge 5*a*).

The tape-like member 14 is fed between the fabric cutter 90 and needles 58 from the tape-like member feeder (not shown), through a guide hole 91. An appropriate degree of tensile force is applied to the tape-like member 14 by tension adjusting means not shown). The tape-like member 14 is disposed so as to cover the first edge 4*a* of the first fabric 4 and the second edge 5*a* of the second fabric 5.

The first fabric 4, second fabric 5 and tape-like member 14 are sewn together by two needle threads T11 running through the first fabric 4 and second fabric 5 and the tape-like member 14 in the thickness direction. At the same time, a decorative thread T12 is engaged between the two needle threads T11, so as to alternately straddle across the two needle threads T11.

Next, the portion including the tape-like member 14 is heated to bond the tape-like member 14 with the first fabric 4 and second fabric 5. The heating may be accomplished in a separate step from the sewing step using a hot press apparatus provided separately from the sewing machine 50. Also, the hot press apparatus may be situated immediately after the sewing machine 50, to perform the heating after the sewing step. The heating is carried out by a method known in the technical field.

Second Embodiment

A second embodiment of the disclosure will now be explained. The explanation will focus primarily on the parts differing with the first embodiment, omitting mention of the parts they have in common.

Figure 8:
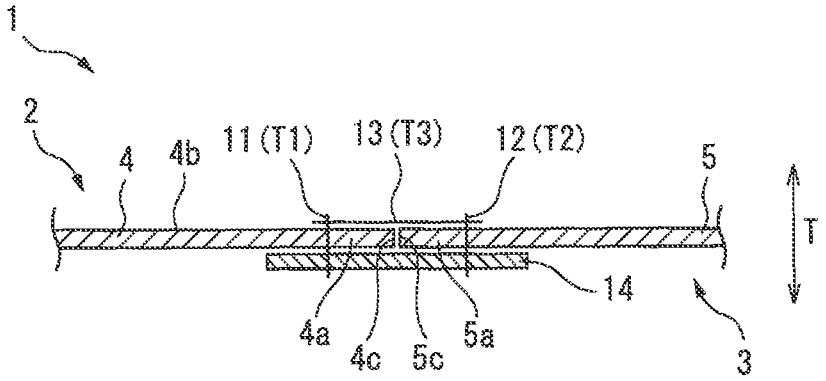
FIG. 8 is a schematic cross-sectional view of a seam structure according to a second embodiment of the disclosure.

FIG. 8 is a cross-sectional view schematically showing the seam structure 1 of this embodiment.

For this embodiment, the first fabric 4 and second fabric 5 are disposed with the edge face 4*c* of the first edge 4*a* and the edge face 5*c* of the second edge 5*a* are in contact with each other.

Also for this embodiment, at the first seam 11, the first thread T1 is disposed running through the first fabric 4 and tape-like member 14 in a repetitive reciprocating manner in the thickness direction T of the first fabric 4 and tape-like member 14, while at the second seam 12, the second thread T2 is disposed running through the second fabric 5 and tape-like member 14 in a repetitive reciprocating manner in the thickness direction T of the second fabric 5 and tape-like member 14.

It is assumed for this embodiment that the second surface 3 of the seam structure 1 is to be used on the skin side of the wearer, and this embodiment allows the thickness of the seam structure to be reduced to further improve the skin contact when worn.

Third Embodiment

Figure 9:
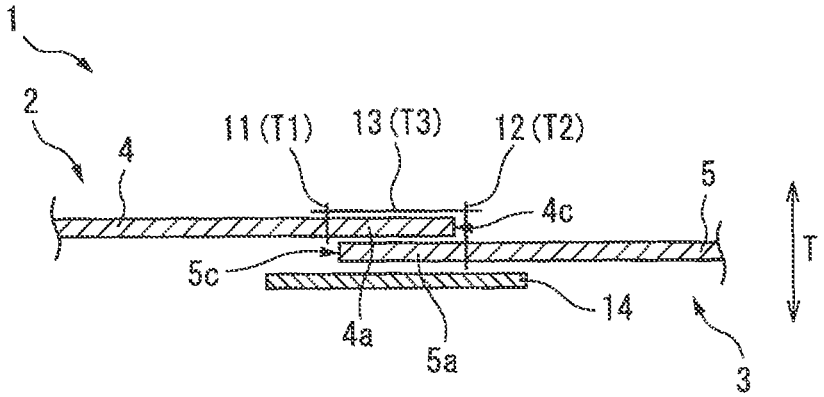
FIG. 9 is a schematic cross-sectional view of a seam structure according to a third embodiment of the disclosure.

A third embodiment of the disclosure will now be explained. The explanation will focus primarily on the parts differing with the first embodiment, omitting mention of the parts they have in common. FIG. 9 is a cross-sectional view schematically showing the seam structure 1 of this embodiment.

For this embodiment, at the first seam 11, the first thread T1 is disposed running through the first fabric 4 in a repetitive reciprocating manner in the thickness direction T of the first fabric, while at the second seam 12, the second thread T2 is disposed running through the second fabric 5 in a repetitive reciprocating manner in the thickness direction T of the second fabric 5.

Also for this embodiment, the first seam 11 and second seam 12 do not run through the tape-like member 14, the tape-like member 14 bonding the first fabric 4 and second fabric 5 from above the first seam 11 and second seam 12.

It is assumed for this embodiment that the second surface 3 of the seam structure 1 is to be used on the skin side of the wearer, and since the wearer is less likely to feel the first seam 11 and second seam 12 during wear, the skin contact is improved.

Fourth Embodiment

Figure 10:
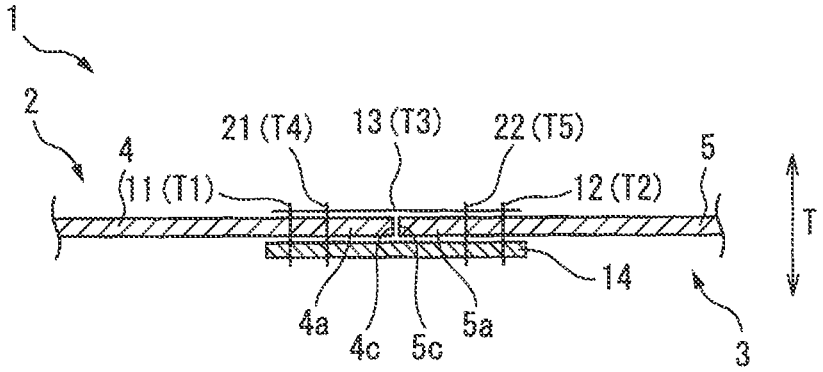
FIG. 10 is a schematic cross-sectional view of a seam structure according to a fourth embodiment of the disclosure.

A fourth embodiment of the disclosure will now be explained. The explanation will focus primarily on the parts differing with the second embodiment, omitting mention of the parts they have in common. FIG. 10 is a cross-sectional view schematically showing the seam structure 1 of this embodiment.

For this embodiment, the seam structure 1 has a fourth seam 21 closer to the first seam 11 and a fifth seam 22 closer to the second seam 12, between the first seam 11 and second seam 12. At the fourth seam 21, the third thread T4 is disposed in a manner running through the first fabric 4 and tape-like member 14 in a repetitive reciprocating manner in the thickness direction T of the first fabric 4 and tape-like member 14, and the fourth seam 21 extends in a direction essentially parallel (not shown) to the direction in which the first seam 11 extends (not shown).

Also, at the fifth seam 22, the fourth thread T5 is disposed in a manner running through the second fabric 5 and tape-like member 14 in a repetitive reciprocating manner in the thickness direction T of the second fabric 5 and tape-like member 14, and extends in a direction essentially parallel (not shown) to the direction in which the second seam 12 extends (not shown).

Moreover, for this embodiment, the decorative thread T3 at the third seam 13 straddles across the first thread T1, second thread T2, third thread T4 and fourth thread T5.

This embodiment has increased strength of the seam structure 1 since the seam structure 1 has the fourth seam 21 and fifth seam 22 in addition to the first seam 11 and second seam 12, and the decorative thread T3 at the third seam 13 straddles across the first thread T1, second thread T2, third thread T4 and fourth thread T5.

The embodiments above were described as examples in which their seam structures are formed with a 4-needle, feed-off-the-arm, interlock stitch machine; however, the seam structure of the disclosure may be formed by another type of sewing machine, such as a 2-needle, flatbed, interlock stitch machine or a 3-needle, flatbed, interlock stitch machine, instead of by a 4-needle, feed-off-the-arm, interlock stitch machine.

When a 2-needle, flatbed, interlock stitch machine or 3-needle, flatbed, interlock stitch machine is used, the seam structure of the disclosure can be formed, for example, by situating the first fabric and second fabric at desired locations and anchoring them with a tape-like member, and then forming the first seam, second seam and third seam in the first fabric, second fabric and tape-like member.

The clothing that is to include the seam structure of the disclosure is not particularly restricted, and may be clothing that is to directly contact with the skin of the wearer, such as, for example, sportswear, such as swimwear, or compression wear, underwear or the like.

EXAMPLES

The present disclosure will now be explained in fuller detail by an example, with the understanding that the disclosure is not meant to be limited to the example.

Example 1

As experimental examples to confirm the effect of the disclosure, there were prepared a sample with the seam structure shown in FIG. 1 to FIG. 3, a sample with a seam structure by conventional flat seaming (formed by seaming with 6 threads: 4 needle threads, 1 looper thread and 1 top cover thread), a sample with a seam structure by conventional 2-needle interlock (after overlook), and a sample with a seam structure by single-cut 2-needle interlock, and their thicknesses were compared.

For all of the samples, the fabrics (first fabric and second fabric) were knitted fabrics with thicknesses of 0.45 mm. Also, the tape-like member had a hot-melt adhesive section, the base was a knitted fabric, and the thickness was 0.2 mm.

In the sample with a seam structure according to the disclosure, polyester thread (#50) was used for the needle thread and decorative thread. In the other samples, polyester thread (#50) was used for the needle thread and Polina (110#) was used for the decorative thread.

The sample with a seam structure according to the disclosure had a thickness of 0.75 mm, the sample with a seam structure by conventional flat seaming had a thickness of 1.44 mm, the sample with a seam structure by 2-needle interlock had a thickness of 1.93 mm, and the sample with a single-cut 2-needle interlock had a thickness of 1.44 mm.

In the seam structure of the disclosure, the thickness at the seam sections was clearly much thinner compared to the conventional seam structure.

Moreover, the surface of the tape-like member side of the sample of the seam structure according to the disclosure had a smooth surface, and reduced skin contact compared to the other samples.

Specifically, the present disclosure relates to the following aspects.

[Aspect 1]

A. seam structure comprising:

a first fabric having a first edge, a second fabric having a second edge, the second fabric being disposed adjacent to the first fabric such that a direction in which the second edge extends is essentially parallel to a direction in which the first edge extends, a first seam formed by a first thread and extending in a direction essentially parallel to the direction in which the first edge extends, a second seam formed by a second thread and extending in a direction essentially parallel to the direction in which the second edge extends, a third seam formed by a decorative thread, and a tape like member having a base and a bonded section, the seam structure having a first surface and a second surface, wherein at the first seam, the first thread is disposed so as to run through at least the first fabric in a repetitive reciprocating manner in a thickness direction thereof, at the second seam, the second thread is disposed so as to run through at least the second fabric in a repetitive reciprocating manner in a thickness direction thereof, the third seam is disposed on the first surface, and at the third seam, the decorative thread is disposed so as to repetitively straddle across at least the first thread and the second thread, and the tape-like member is disposed on the second surface, the bonded section of the tape-like member bonding the first fabric and the second fabric.

[Aspect 2]

The seam structure according to aspect 1, wherein an edge face of the first edge of the first fabric lies between the first seam and second seam.

[Aspect 3]

The seam structure according to aspect 1 or 2, wherein the first fabric and second fabric are disposed with the first edge and second edge overlapping in a thickness direction of the seam structure.

[Aspect 4]

The seam structure according to aspect 1 or 2, wherein the first fabric and second fabric are disposed with the edge face of the first edge and the edge face of the second edge are in contact with each other.

[Aspect 5]

The seam structure according to any one of aspects 1 to 4, wherein at the first seam, the first thread is disposed running through the first fabric and tape-like member in a repetitive reciprocating manner in a thickness direction thereof, and at the second seam, the second thread is disposed running through the second fabric and tape-like member in a repetitive reciprocating manner in a thickness direction thereof.

[Aspect 6]

The seam structure according to any one of aspects 1 to 5, wherein the base is a knitted fabric.

[Aspect 7]

The seam structure according to any one of aspects 1 to 6, wherein the seam structure has a fourth seam closer to the first seam and a fifth seam closer to the second seam, between the first seam and second seam, and at the fourth seam, the third thread is disposed running through at least the first fabric in a repetitive reciprocating manner in a thickness direction thereof, while at the fifth seam, the fourth thread is disposed running through at least the second fabric in a repetitive reciprocating manner in a thickness direction thereof.

[Aspect 8]

The seam structure according to aspect 7, wherein at the third seam, the decorative thread straddles across at least two threads selected from among the first thread, second thread, third thread and fourth thread.

[Aspect 9]

The seam structure according to any one of aspects 1 to 8, wherein the seam structure is formed by a 4-needle, feed-off-the-arm, interlock stitch machine, a 2-needle, flatbed, interlock stitch machine, or a 3-needle, flatbed, interlock stitch machine.

[Aspect 10]

Clothing comprising a seam structure according to any one of aspects 1 to 9.

REFERENCE SIGNS LIST

1 Seam structure
2 First surface
3 Second surface
4 First fabric
4*a* First edge
4*b* Surface
4*c* Edge face
5 Second fabric
5*a* Second edge
5*c* Edge face
11 First seam
12 Second seam
13 Third seam
14 Tape-like member
14*a* Surface
21 Fourth seam
22 Fifth seam
T1 First thread
T2 Second thread
T3 Decorative thread
T4 Third thread
T5 Fourth thread
W Width
T Thickness direction
D Direction

The invention claimed is:

1. A seam structure comprising:

a first fabric having a first edge, a second fabric having a second edge, the second fabric being disposed adjacent to the first fabric such that a direction in which the second edge extends is parallel to a direction in which the first edge extends, a first seam formed by a first thread and the first seam extending in a direction parallel to the direction in which the first edge extends, a second seam formed by a second thread and the second seam extending in a direction parallel to the direction in which the second edge extends, a third seam formed by a decorative thread, and a tape member having a base and a bonded section, the seam structure having a first surface and a second surface, wherein at the first seam, the first thread is disposed so as to run through at least the first fabric in a repetitive reciprocating manner in a thickness direction of the seam structure, at the second seam, the second thread is disposed so as to run through at least the second fabric in a repetitive reciprocating manner in the thickness direction of the seam structure, the third seam is disposed on the first surface, and at the third seam, the decorative thread is disposed so as to be the only thread to repetitively straddle across at least the first thread and the second thread, the tape member is disposed on the second surface, the bonded section of the tape member bonding the first fabric and the second fabric, and wherein the third seam is only disposed on the first surface;

wherein at the first seam, the first thread is disposed running through the first fabric and tape member in a repetitive reciprocating manner in a thickness direction of the seam structure, and at the second seam, the second thread is disposed running through the second fabric and tape member in a repetitive reciprocating manner in the thickness direction of the seam structure;

wherein an edge face of the first edge of the first fabric and an edge face of the second edge of the second fabric lie between the first seam and second seam; and wherein the edge face of the first edge of the first fabric overlaps the edge face of the second edge of the second fabric in the thickness direction of the seam structure.

2. The seam structure according to claim 1, wherein the base is a knitted fabric.

3. The seam structure according to claim 1, wherein the seam structure has a fourth seam and a fifth seam disposed between the first seam and second seam, wherein the fourth seam is closer to the first seam than the second seam, wherein the fifth seam is closer to the second seam than the first seam, wherein at the fourth seam, a third thread is disposed running through at least the first fabric in a repetitive reciprocating manner in the thickness direction of the seam structure, and wherein at the fifth seam, a fourth thread is disposed running through at least the second fabric in a repetitive reciprocating manner in the thickness direction of the seam structure.

4. The seam structure according to claim 3, wherein at the third seam, the decorative thread straddles across at least two threads selected from among the first thread, second thread, third thread and fourth thread.

5. The seam structure according to claim 1, wherein the seam structure is formed by a 4-needle, feed-off-the-arm, interlock stitch machine, a 2-needle, flatbed, interlock stitch machine, or a 3-needle, flatbed, interlock stitch machine.

6. Clothing comprising the seam structure according to claim 1.

7. The seam structure according to claim 1, wherein the tape member is only disposed on the second surface.

* * * * *